United States Patent [19]

Woodward

[11] Patent Number: 4,785,588

[45] Date of Patent: Nov. 22, 1988

[54] LIQUID BLASTING SYSTEM

[75] Inventor: Michael J. Woodward, Houston, Tex.

[73] Assignee: Weatherford U.S., Inc., Houston, Tex.

[21] Appl. No.: 947,837

[22] Filed: Dec. 30, 1986

[51] Int. Cl.[4] ..... B24C 3/06

[52] U.S. Cl. ..... 51/429; 51/424; 51/410; 134/172; 134/175

[58] Field of Search ..... 51/429, 424, 410, 425, 51/321, 439; 134/172, 175, 177, 198, 200; 15/302

[56] References Cited

U.S. PATENT DOCUMENTS

| | | | |
|---|---|---|---|
| 2,684,558 | 7/1954 | Harris et al. | 51/429 |
| 3,004,279 | 10/1961 | Ringer | 51/429 |
| 3,609,916 | 10/1971 | Hammelmann | 134/172 |
| 3,654,662 | 4/1972 | Bates | 15/302 |
| 3,799,440 | 3/1974 | Goss . | |
| 3,802,628 | 4/1974 | Goss . | |
| 3,925,935 | 12/1975 | Ricklefs | 51/429 |
| 4,249,956 | 2/1981 | Hartman | 51/321 |
| 4,376,443 | 3/1983 | Mondy . | |

FOREIGN PATENT DOCUMENTS

| | | | |
|---|---|---|---|
| 0167768 | 8/1985 | Japan | 51/429 |
| 0487532 | 6/1938 | United Kingdom | 51/429 |

OTHER PUBLICATIONS

NLB Corp. (prior to Dec. 1985) "Surface Preparation, Highways".

Bowen, 1985 (prior to Dec. 1985), "Bowen Industrial Products High Pressure Washers".

Butterworth, 1985 (prior to Dec. 1985), "The Liqua--Blaster".

Weatherford Water Jetting Systems American Water Blaster 1986-87 Accessories Catalog.

Weatherford Water Jetting Systems, pp. 6709-6711 (47-49).

*Primary Examiner*—Frederick R. Schmidt

*Assistant Examiner*—Robert A. Rose

*Attorney, Agent, or Firm*—Vaden, Eickenroht, Thompson & Boulware

[57] ABSTRACT

A liquid blasting system for blasting an area, surface, structure, part, item, or member with liquid or with liquid and abrasives, or with a liquid-abrasive mixture. The system has a housing through which are disposed a plurality of inlets or nozzles. Liquid, e.g. water, under pressure is transmitted through the inlets or nozzles to the area, etc. to be blasted. Abrasives, e.g. sand, may be injected with the liquid or separate abrasive injection inlets or nozzles may be employed in connection with the liquid inlets or nozzles. The inlet or nozzle housing can communicate with a collection housing for receiving blasted material, liquid, and abrasives and the collection housing can have ports therein through which these liquids and materials can exit. The ports can be suitable for connecting thereto a vacuum source for sucking materials and liquid from the nozzle housing, to and through the collection housing, and thence out of the collection housing.

4 Claims, 3 Drawing Sheets

LIQUID BLASTING SYSTEM

BACKGROUND OF THE INVENTION

1. Field of the Invention

This invention is directed to liquid blasting systems; to such blasting systems employing abrasive particulates such as sand with the liquid; and particularly to blasting systems with a plurality of liquid and abrasive inlets or nozzles or liquid/abrasive inlets and with a protective housing or shroud provided with vacuum removal of liquid, abrasives, and blasted materials.

2. Description of the Prior Art

Prior art liquid blasting systems are utilized for the cleaning of parts and materials in a variety of industries and enterprises. Such systems employ liquids under pressures ranging from 500 to 50,000 p.s.i. and liquid velocities from 800 to 1250 feet per second.

A typical prior art system is a single-operator high pressure gun as disclosed in U.S. Pat. No. 3,799,440. Various problems are associated with the structure and use of such guns. Many guns are heavy and cumbersome. During operation a reaction force of as much as 40 pounds must be dealt with by the operator. This can be very tiring.

Often, as described in U.S. Pat. No. 3,802,628 a plurality of individually controlled high pressure blast guns will be connected to the same power source. Each gun requires its own operator. Problems associated with such a multiple-gun hook-up to a single power source are similar to the problems encountered with the use of single guns.

The NLB Spin Jet is a liquid blasting system which employs four liquid nozzles with a housing or body. The nozzle or nozzles are located under the housing where they are connected to a rotating member. There is no vacuum on any part of the device to remove fluid or abrasives. The NLB Corp. expansion joint cleaning system uses another NLB Corp. "Expansion Joint Cleaner" which is similar to the NLB Spin Jet. The NLB apparatuses cannot adequately deal with abrasives.

There has long been a need for a liquid blasting system which has a high production rate, requires only one operator, uses abrasives more effectively, is of simple construction and easy to repair, and which eliminates health and environmental problems related to such systems.

SUMMARY OF THE PRESENT INVENTION

The present invention is directed to a novel liquid blasting system which overcomes the problems and disadvantages of the prior art devices in an efficient and safe manner. A liquid blasting system according to the present invention has a housing with multiple inlets for receiving liquid, e.g., water, under high pressure and multiple inlets for receiving abrasives, e.g. sand; or multiple inlets for receiving a liquid/abrasive mixture under high pressure. The liquid and abrasives can be injected through nozzles disposed in and through the housing. The housing is a shell with the inlets arranged in it so that a liquid or liquid/abrasive mixture is impinged at high pressure onto the surface or article over which the housing is positioned for cleaning or blasting the surface or article. A vacuum apparatus is provided for removing liquid, abrasives, or blasting particles from within the housing. A circuitous path is provided for the vacuumed particles for efficient collection of the particles. The housing can be mobile for movement on ground, highway, or flat surfaces, having appropriate wheels or tires connected to it so that a single operator can move it easily.

The power source for a liquid blast system according to the present invention can be located externally to or remotely to the system; e.g. a powered vehicle can provide the necessary power.

It is therefore, an object of this invention to provide a novel and efficient liquid blasting system.

Another object of the present invention is the provision of such a system having a protective blast housing, shell or shroud.

A further object of the present invention is the provision of such a system having a vacuum apparatus for removing liquid, abrasives, or particles resulting from blasting from the area within the housing.

An additional object of the present invention is the provision of such a system having a plurality of inlets for liquid/abrasive mixture.

A particular object of the present invention is the provision of such a system in which spray nozzles extend into the housing and are connected to the inlets. Another object of the present invention is the provision of such a system in which a channel or channels are used to provide a circuitous flow path for the vacuum removal from within the housing.

Yet another object of the present invention is the provision of a liquid blasting system which has a high production rate yet which meets or exceeds health and environmental standards.

To one of skill in this art who has the benefit of this invention's teachings other and further objects and advantages will be clear from the following description of presently preferred embodiment of the invention, given for the purpose of disclosure, then taken in combination with the accompanying drawings.

DESCRIPTION OF PREFERRED EMBODIMENT

Figure 1:
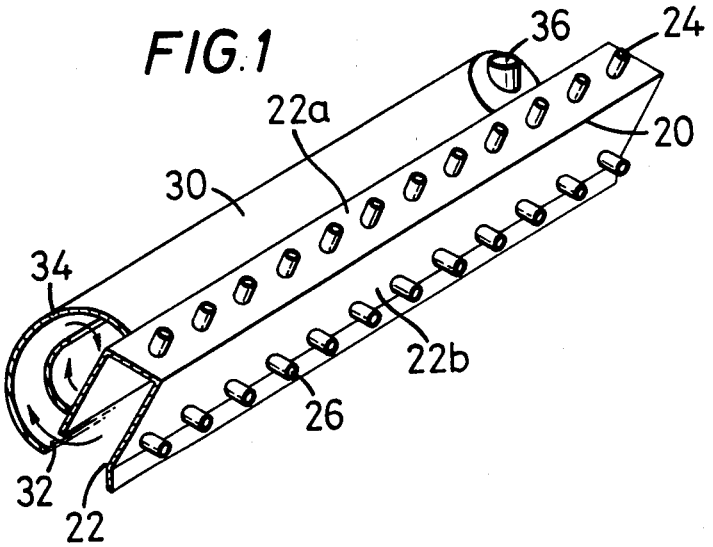
FIG. 1 is a perspective view, partially cutaway showning the housing and inlets of the system.

As illustrated in FIG. 1, the housing 20 is an elongated generally U-shaped member with an opening 22 at the bottom. The opening 22 is positioned over the surface or area to be blasted. A plurality of water inlets 24 (twelve in FIG. 2) are disposed along the top **22*a* of housing 22. The inlets 24 communicate with the interior of the housing 22 and transmit water under high pressure (up to 50,000 p.s.i.) onto the part, surface or area to be blasted. A plurality of sand inlets 26 (twelve on FIG. 2) are disposed on the lateral portion 22*b* of the housing 22**.

Rather than having sand injected through the inlets 26, a mixture of water and sand can be injected through the inlets 24. Although inlets can be disposed at any desired angle with respect to the housing, the inlets 25 and 26 are at right angles to the housing (90°).

Figure 2:
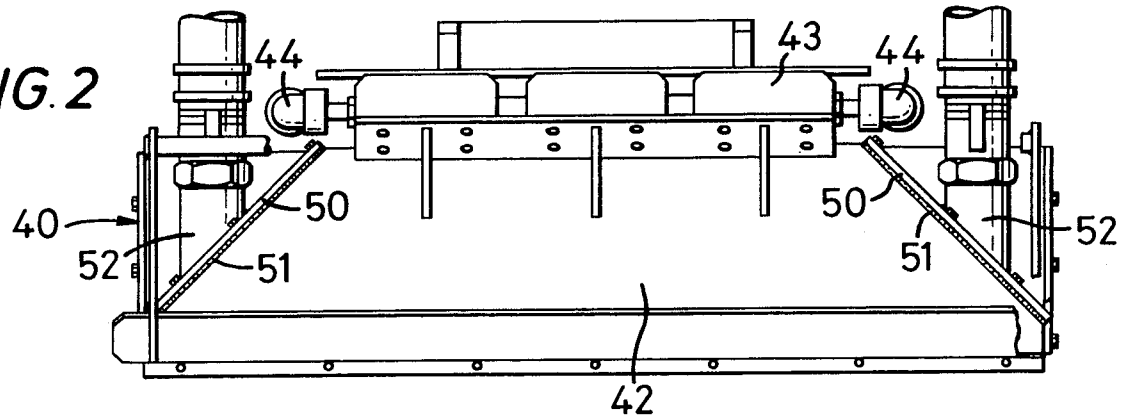
FIG. 2 is a frontal view showing parts of a liquid blast system according to the present invention.
Figure 3:
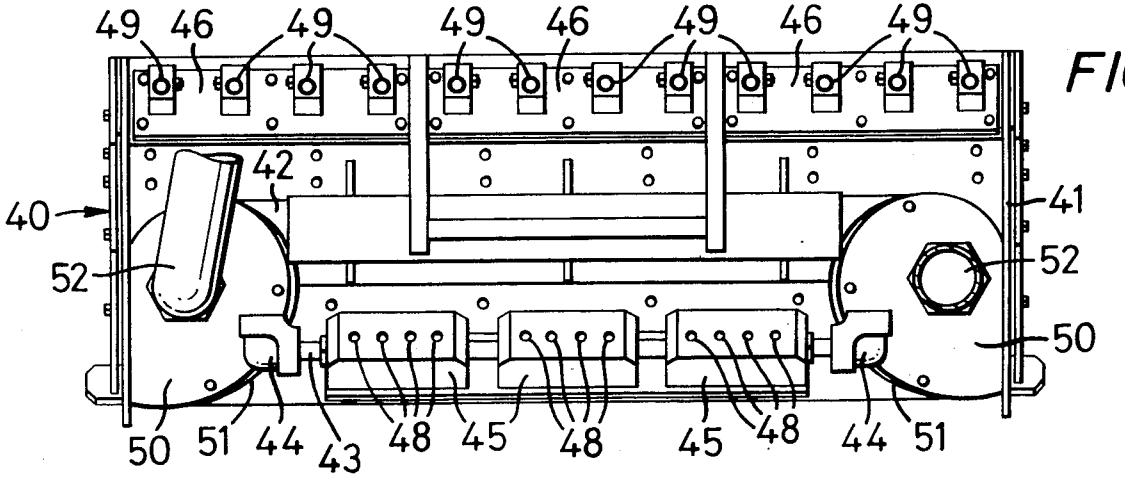
FIG. 3 is a top view of the system of FIG. 2.
Figure 4:
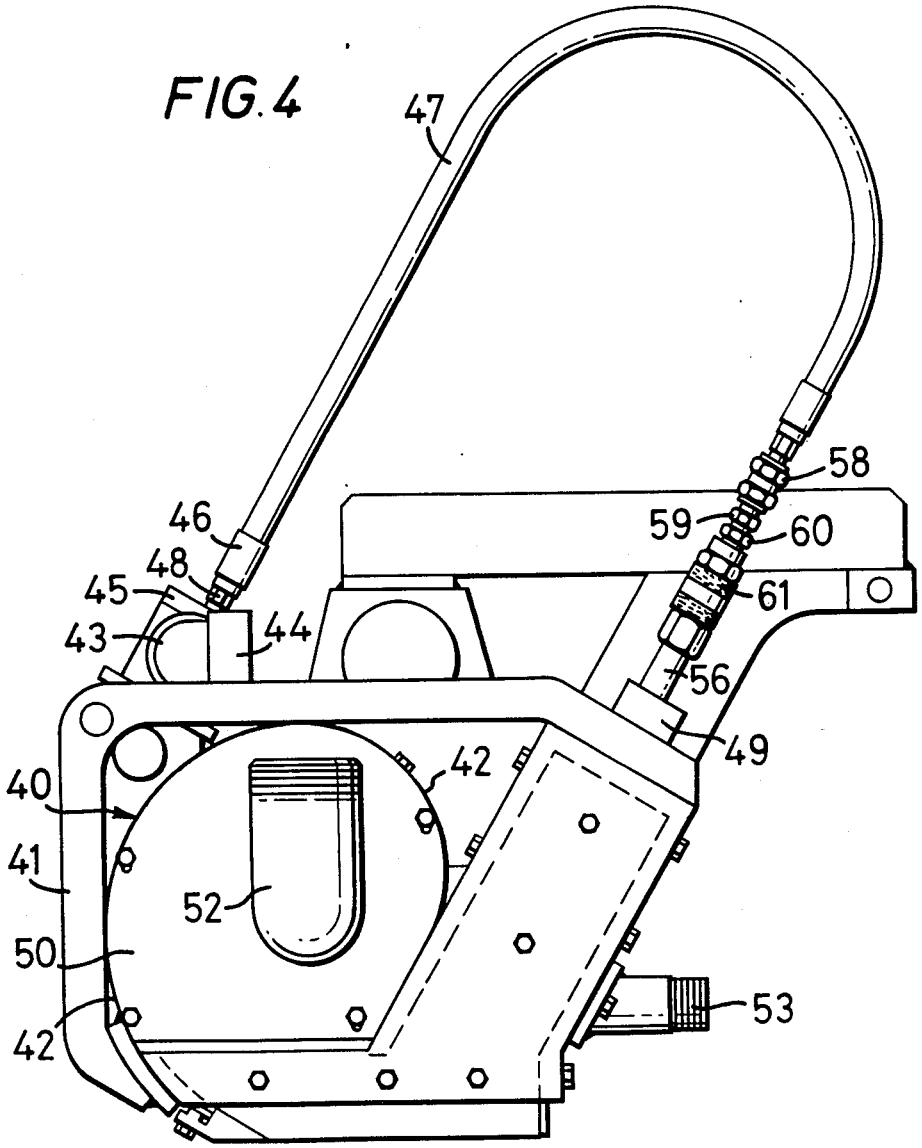
FIG. 4 is a side view of the system of FIG. 2 with a water injection hose.

Connected to the housing 22 is an involute catcher assembly 30 for receiving and removing water, sand, and blasted material from the housing 22. Such materials and fluids are sucked from within the housing 22, through an opening 32 into the catcher 30. The fluid and material follows a circuitous path through a circular channel 34 formed within the catcher 30 and thence to an exit port 36 at the end of the catcher 30. A vacuum hose (not shown in FIG. 1) is connected to the exit port 36 for creating the vacuum within the catcher 30. Although only one exit port 36 is shown in FIG. 1, two such ports are preferred as shown in the embodiment of FIG. 2.

Another embodiment of the invention is illustrated in FIGS. 2–5. The blast device 40 has a handling frame 41 which partially encompasses the device. A collection shroud 42 extends for almost the entire length of the device 40. A water inlet apparatus 43 including water inlet pipes 44 and a plurality of water inlet manifolds 45 is mounted to the top of the shroud 42 for receiving high pressure water from a high pressure water source. The high pressure water is communicated from the water inlet manifolds 45 to nozzle mounts 46 with hoses 47 (one shown in FIG. 4). A hose such as hose 47 extends from each manifold hose outlet 48 to each nozzle hose inlet 49. It is to be understood that this invention is not limited to the use of 12 water nozzles as suggested in FIGS. 2 and 3, but is directed to the use of a plurality of nozzles.

Each of the ends of the shroud 42 are closed off with a cover 50 and a gasket 51. Abrasives, liquid, and blasted material are sucked up from within the shroud 42 by a vacuum supplied through vacuum ports 52 provided at the ends of the shroud 42 and whose output can be conveyed to a tank adjacent to the device 40 or a tank or reservoir remotely located from the device 40 by the use of suitable transmission hoses (not shown).

Figure 5:
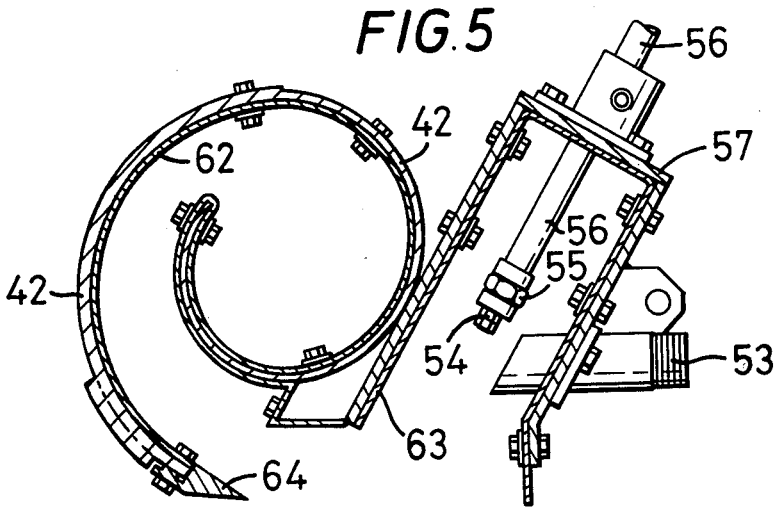
FIG. 5 is a partial cross-sectional view of the system of FIG. 4.

A plurality of sand injection nozzles 53 (one shown in FIGS. 4 and 5) are disposed in and through the back side of a blast shroud 57 so that one sand injection nozzle is disposed to inject sand near the output end of each of a plurality of water injection nozzles 54 (one shown in FIG. 5). The water nozzle 54 is connected to a coupling 55 which is itself connected to a pipe 56 which extends through and is sealingly disposed in the blast shroud 57. The hose 47 is connected to a filter 58 (a five micron filter has been used) which is connected to a nipple 59 which is in turn connected to a bushing 60 which is connected to a quick disconnect assembly 61. The quick disconnect assembly can be quickly disconnected from the pipe 56 to which it is connected during operation.

As shown in FIG. 5, the collection shroud is spiral-shaped and communicates with the blast shroud 57 so that blasted material can be sucked up from the area beneath the nozzles 54 and 53 into the collection shroud 42 from which, via vacuum action, they are expelled along with water and sand.

An inside protective liner 62 is provided within the collection shroud 42 and a similar liner 63 is provided within the blast shroud 57. The liners can be made of material which can withstand the high pressures and abrasives within the shrouds such as stainless steel or aluminum of sufficient thickness. The nozzles 54 are so disposed in the shroud 57 that the entire area to be blasted under the shroud is subjected to blast from at least one nozzle. The water nozzle 54 as shown has a 25° fan, but it is to be understood that this is a preferred rather than a limiting fan range.

The system according to the present invention depicted in FIGS. 2–5 is designed to operate at pressures up to 800 bar and clean a path 1.2 meters wide, either vertically or horizontally depending on whether the system is moved across a floor or held upright and moved along a wall. The system can also be used for degreasing by injecting a surfactant or soap into the blast water. A shroud seal 64 is connected to the leading edge of the shroud 42 to prevent the flow of materials beyond the edge exteriorly of the shroud.

To blast rusted steel structures to a SA 2½ finish and to realize a blasting production rate of 250 square meters per hour using single wet sand blast control guns such as the Weatherford M-20 Control Gun, required fourteen operators, each with his own individual gun. After the blasting operation was completed, a vacuum hose was used to clean up abrasives, rust, blasting material, etc. A mobile device according to the present invention utilizing twelve sand injection inlets and twelve water inlets achieved a production rate of 250 square meters per hour using one operator with the water pressure in each instance for the individual guns being 7000 p.s.i.; and for guns on the multiple system also at 7000 p.s.i.

It is seen, therefore, that the present invention is well-suited to carry out the ends and attain the advantages set forth herein. To one of skill in this art who has the benefit of this invention's teachings, it will be clear that certain changes can be made in the embodiments disclosed herein without departing from the spirit of the invention as defined in the following claims.

What is claimed is:

1. A liquid blasting system for blasting liquid or a liquid-abrasive mixture onto an area to be blasted, the system comprising a housing having an interior, liquid inlet means disposed on and through the housing and communicating with the housing's interior for receiving liquid under pressure and transmitting it to the area to be blasted, a hollow catcher having an interior and an exit port and comprising an involuted channel of spiral-shaped cross-section, the involuted channel having an opening in communication with the housing's interior and disposed to receive liquid and blasted materials from the area to be blasted, material flowing into the involuted channel passing through a circuitous path in the channel before exiting through the one or more exit connections, and one or more exit connections on the catcher for attaching vacuum means to and in communication with the catcher for sucking liquid and blasted material out of the catcher.

2. The system of claim 1 wherein the catcher's interior has a protective liner for withstanding high pressures or abrasives.

3. The system of claim 1 including one or more abrasive injection inlets disposed on the housing for injecting abrasives into the liquid flowing from the liquid inlet means.

4. A liquid blasting system for blasting liquid or a liquid-abrasive mixture onto an area to be blasted, the system comprising a housing having an interior, liquid inlet means disposed on and through the housing and communicating with the housing's interior for receiving liquid under pressure and transmitting it to the area to be blasted, a hollow catcher having an interior and comprising an involuted channel of spiral-shaped cross-section, the involuted channel having an opening in communication with the housing's interior and disposed to receive liquid and blasted materials from the area to be blasted, the catcher's interior having a protective liner for withstanding high pressures or abrasives, and wherein the catcher has one or more exit ports and liquid and blasted material flowing into the involuted channel passes through a circuitous path in the channel before exiting through the one or more exit ports, and one or more exit connections one each in communication with the one or more exit ports on the catcher for attaching vacuum means to and in communication with the catcher for sucking material out of the catcher, and one or more abrasive injection inlets disposed on the housing for injecting abrasives into the liquid flowing from the liquid inlet means.

* * * * *